United States Patent [19]

Gramling

[11] 4,113,010

[45] Sep. 12, 1978

[54] CASING STOP FOR WELL TOOLS AND AN INSERTION DEVICE THEREFORE

[76] Inventor: William Dwight Gramling, 5144 Newport Ave., Chevy Chase, Md. 20016

[21] Appl. No.: 788,781

[22] Filed: Apr. 19, 1977

Related U.S. Application Data

[60] Division of Ser. No. 687,916, May 19, 1976, Pat. No. 4,070,134, which is a continuation-in-part of Ser. No. 569,056, Apr. 17, 1975, abandoned.

[51] Int. Cl.[2] ..... E21B 23/02

[52] U.S. Cl. ..... 166/213; 294/86.24; 294/93

[58] Field of Search ..... 166/136, 214, 215, 216, 166/213; 294/86.24, 93, 97

[56] References Cited

U.S. PATENT DOCUMENTS

| | | | |
|---|---|---|---|
| 2,991,835 | 7/1961 | Schwab | 166/214 |
| 3,064,737 | 11/1962 | Quinn | 166/214 |
| 3,128,828 | 4/1964 | Skinner | 294/86.24 |

*Primary Examiner*—Stephen J. Novosad
*Assistant Examiner*—William F. Pate, III

[57] ABSTRACT

A well anchor for use in a cased well having anchor members of bowed springs and a vertically reciprocable rod actuator movable from the surface to set the anchor.

2 Claims, 2 Drawing Figures

CASING STOP FOR WELL TOOLS AND AN INSERTION DEVICE THEREFORE

This is a continuation in part of Ser. No. 596,056 filed April 17, 1975 now abandoned and a divisional of Ser. No. 687,916 filed May 19, 1976 now U.S. Pat. No. 4,070,134.

A stand is necessary to prevent the swab device from passing below the perforations in the well casing where the gas enters, rendering it useless.

Figure 1:
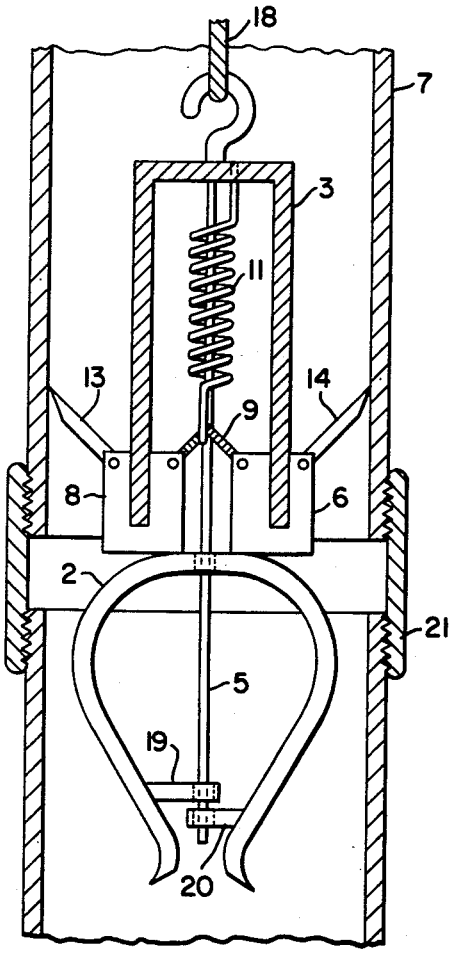
Figure 2:
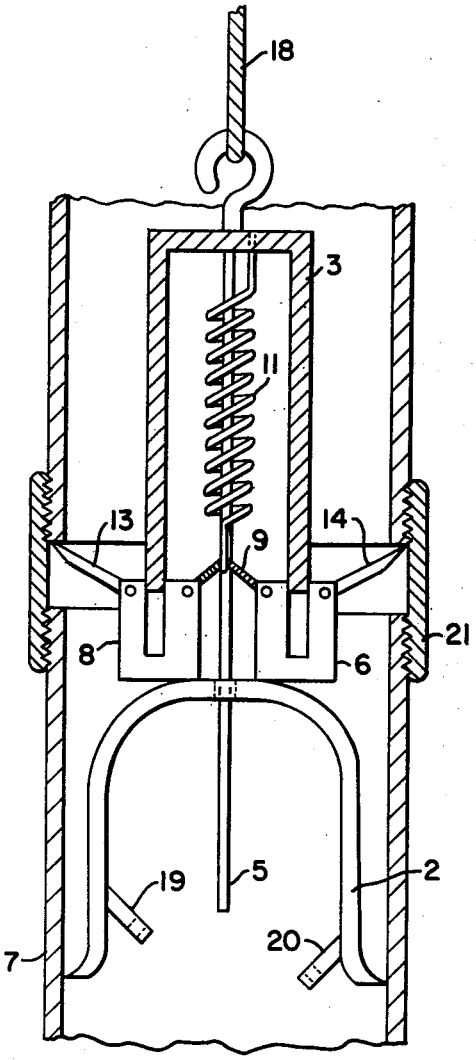

Referring to FIGS. 1 and 2, the preferred embodiment of a stand is a spring-steel bar 2, shown compressed in FIG. 1 and expanded against the well casing in FIG. 2.

The ejecting device consists of a cylindrical body 3 capped at the top and open at the lower end with a steel rod 5 fixed to the cap and protruding down through and beyond the end of the body 3. Slidable on the bottom of the body 3 are two fittings 6, 8. The fittings 6,8 are joined by a flexible cable 9 which is connected to the body 3 by an expanded spring 11. The spring 11 holds the fittings 6,8 upwards against the body 3. Tabs 13, 14 are hinged to the top of the fittings 6, 8 and are held in a downward tension against the well casing 7 by springs incorporated into the hinges. The downwardly-facing semi-circle of spring steel bar 2 is compressed and placed on the rod 5 through a hole at the top of the bar 2 and through holes in the two tabs 19, 20 which have been attached to the bar 2. The tabs 19, 20 hold the bar 2 in compression and the spring tension of the bar 2 against the rod 5 supports the weight of the bar 2 until the bar is ejected. The body 3 is attached to a cable 18 for purpose of lowering the ejecting device into the well casing. The operation of the stand-ejecting device is as follows: The ejecting device with the spring steel bar stand 2 attached to the rod 5 is lowered into the well casing to a predetermined depth. The tabs 13, 14 are presently oriented upward and slide along the casing wall, offering no resistance to the downward movement of the ejecting device. When the device and stand are several feet above the predetermined depth, they are pulled back toward the top of the casing. When the device passes the pipe connector 21, the tabs 13, 14 catch in the indentation formed by the joining of two pipe casings by the pipe connector 21. This arrests the upward movement of the fittings 6, 8 and, consequently, the bar 2. However, the body 3 and the rod 5 continue to move upward, pulled by the cable 18. The rod 5 slides out of the holes in tabs 19, 20, allowing the bar 2 to spring out against the sides of the casing 7. When the fittings 6, 8 reach their bottommost travel on the body 3, they are pushed upward partially into the body 3 by the spring 11. The tabs 13, 14 have folded downward and the entire ejecting device is now free to be pulled upward and removed from the well casing. The bar 2 has been ejected and is positioned in the well casing. When pushed down to the next pipe connector, the bar 2 will serve as a stand for the swabbing device.

Another embodiment of the ejecting device is to incorporate a cylindrical enclosure in place of the rod 5. The enclosure is open at both ends, one end attached to the open lower end of the body 3. The enclosure is notched at the top to allow downward movement of the fittings 6, 8 and its inside diameter is large enough to accommodate the insertion of the compressed bar 2. The enclosure holds the bar 2 in its compressed state until the downward movement of the fittings 6, 8 eject the bar 2 out of the enclosure into the well casing.

What I claim is:

1. Means for positioning and ejecting a restricting stop in well casing, said means comprising a vertically oriented body open at the lower end, fittings slidable on lower end of said body, said fittings provided with resilient tabs held against and slidable on said casing, said fittings attached to said body, a vertically positioned rod attached to the top of and projecting through said open lower end of said body, a downwardly facing semi-circle of resilient bar compressed and slidable on said rod, said fittings remaining stationary relative to said body during downward movement of said ejecting means relative to said casing, said fittings remaining stationary relative to said casing and moving downward relative to said body during upward movement of said ejecting means relative to said casing, said downward movement of fittings relative to said body causing downward movement of said bar relative to said rod, said bar becoming ejected from said ejecting means, said bar contacting said well casing and becoming stationary in said well casing at a predetermined depth.

2. Means in accordance with claim 1 wherein an open-ended enclosure extends from the lowermost portion of said body, said enclosure to contain and compress said bar until ejection.

* * * * *